US009422903B2

(12) United States Patent
Roseborsky et al.

(10) Patent No.: US 9,422,903 B2
(45) Date of Patent: Aug. 23, 2016

(54) CONNECTING ELEMENT FOR GDI TUBE STRESS REDUCTION

(71) Applicants: DENSO International America, Inc., Southfield, MI (US); DENSO CORPORATION, Kariya, Aichi-pref. (JP)

(72) Inventors: Steven Roseborsky, Kingsville (CA); Dhyana Ramamurthy, Novi, MI (US); Tetsuo Ogata, Ann Arbor, MI (US)

(73) Assignee: DENSO International America, Inc., Southfield, MI (US)

( * ) Notice: Subject to any disclaimer, the term of this patent is extended or adjusted under 35 U.S.C. 154(b) by 88 days.

(21) Appl. No.: 13/874,499

(22) Filed: May 1, 2013

(65) Prior Publication Data

US 2014/0326217 A1 Nov. 6, 2014

(51) Int. Cl.

| | |
|---|---|
| ***F02M 69/46*** | (2006.01) |
| ***F02M 69/50*** | (2006.01) |
| ***F02M 61/14*** | (2006.01) |

(52) U.S. Cl.

CPC ..... *F02M 69/50* (2013.01); *F02M 61/14* (2013.01); *F02M 2200/856* (2013.01); *F02M 2200/857* (2013.01)

(58) Field of Classification Search

USPC ..... 123/469, 470, 456

See application file for complete search history.

(56) References Cited

U.S. PATENT DOCUMENTS

| | | | | |
|---|---|---|---|---|
| 5,735,247 | A * | 4/1998 | Tsuzuki et al. | 123/470 |
| 6,073,612 | A * | 6/2000 | Ohkubo et al. | 123/456 |
| 6,318,341 | B1 * | 11/2001 | Gmelin et al. | 123/470 |
| 7,683,771 | B1 | 3/2010 | Loeb | |
| 8,522,754 | B2 * | 9/2013 | Lazich | 123/470 |
| 2003/0213472 | A1 * | 11/2003 | Suzuki et al. | 123/469 |
| 2004/0020469 | A1 * | 2/2004 | Reiter et al. | 123/470 |
| 2009/0145504 | A1 * | 6/2009 | Colletti et al. | 138/89 |
| 2011/0001726 | A1 | 1/2011 | Buckingham et al. | |
| 2012/0138020 | A1 | 6/2012 | Kweon et al. | |

FOREIGN PATENT DOCUMENTS

| | | | |
|---|---|---|---|
| GB | EP 1457663 | A2 | 9/2004 |
| JP | 2001-50134 | A | 2/2001 |
| KR | 10-0764967 | B1 | 10/2007 |

* cited by examiner

*Primary Examiner* — Hung Q Nguyen

(57) ABSTRACT

In a GDI fuel rail mounting system comprising a fuel injection rail, having at least one fuel injector receiving cup with a generally cylindrical shape directly attached to the fuel rail generally perpendicular to and offset from the center of the fuel rail. The fuel rail further comprising at least one generally cylindrical attachment means proximal the fuel injector receiving cup, also attached to the fuel rail offset from the center thereof, the attachment means and the fuel injector receiving cup being disposed generally parallel to each other. A securing strap is attached to the outer curvature of at least one of the injector receiving cup and the attachment means, at least partially wrapping around the outer periphery of the attachment means, thereby inhibiting torsional, lineal, and lateral movement of the injector cup relative to the attachment means and the fuel rail.

7 Claims, 5 Drawing Sheets

CONNECTING ELEMENT FOR GDI TUBE STRESS REDUCTION

FIELD

The present disclosure relates to a structure for attaching a fuel rail utilized in gasoline direct injection (GDI) vehicles.

BACKGROUND

This section provides background information related to the present disclosure which is not necessarily prior art.

All internal combustion engines require some type of fuel delivery means to provide fuel to the internal combustion engine. One of the current systems utilizes gasoline direct injection, which is delivered through a plurality of injectors, connected to a common rail above the intake of the engine. The fuel is delivered to each individual cylinder under high pressure, so a secure attachment of the fuel rail to the cylinder head of the engine is critical.

This high pressures under which Direct Injection Systems operate can cause strain on the fuel interface between the attachment of each individual fuel injector and the fuel rail itself, often causing premature failure.

One example of a countermeasure to this stress is disclosed in US patent application 2012/0138020 by applicants Kweon et al. In this reference, a bridge is implemented between an individual injector mounting cup and a fuel rail mounting unit. This bridge serves a similar purpose as to disperse the energy from the fuel injection action to both the fuel rail and the fuel rail mounting point.

One shortcoming of this reference is that the bridge is disposed directly between the fuel injector cup and the mounting point, and therefore can only minimize the twisting effect from rotational force of the injector cup relative to the mounting point to a limited degree before the connection of the bridge to either the injection cup and or the mounting point would fail. This is because between the attachment of the bridge and the attachment to the rail, the injector cup is only secured within 90 degrees or so of its 360 degree circumference. As the additional reference is included, we can compare side by side analysis of the prior art and the current disclosure thereto.

Furthermore, with the fuel injector cup being integrated with the mounting point, it is difficult to manufacture or install with correct precision, requiring either to be co-formed with the injector cup and/or mounting point, or inserted between the injector cup and the mounting point and subsequently bonded thereto.

Lastly, due to the increasing demand to make vehicles lighter and more fuel efficient, every little bit of added weight is important, and by design, the bridge disclosed in the above prior art adds unnecessary weight to the vehicle.

SUMMARY

This section provides a general summary of the disclosure, and is not a comprehensive disclosure of its full scope or all of its features.

In light of the above mentioned short comings in the prior art, the present disclosure provides for a more robust and economical means of preventing strain on a fuel injector connected to a fuel rail in a GDI fuel delivery system.

The present disclosure discloses a GDI fuel rail mounting system comprising a fuel injection rail, having at least one fuel injector receiving cup having a generally cylindrical shape directly attached to the fuel rail generally perpendicular to and offset from the center of the fuel rail. The fuel rail further comprises at least one generally cylindrical attachment means proximal the fuel injector receiving cup, also attached to the fuel rail offset from the center thereof, the attachment means and the fuel injector receiving cup being disposed generally parallel to each other.

A securing strap is attached to the outer curvature of both the injector receiving cup and the attachment means, at least partially wrapping around the outer periphery of the attachment means, thereby inhibiting torsional, lineal, and lateral movement of the injector cup relative to the attachment means and the fuel rail.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
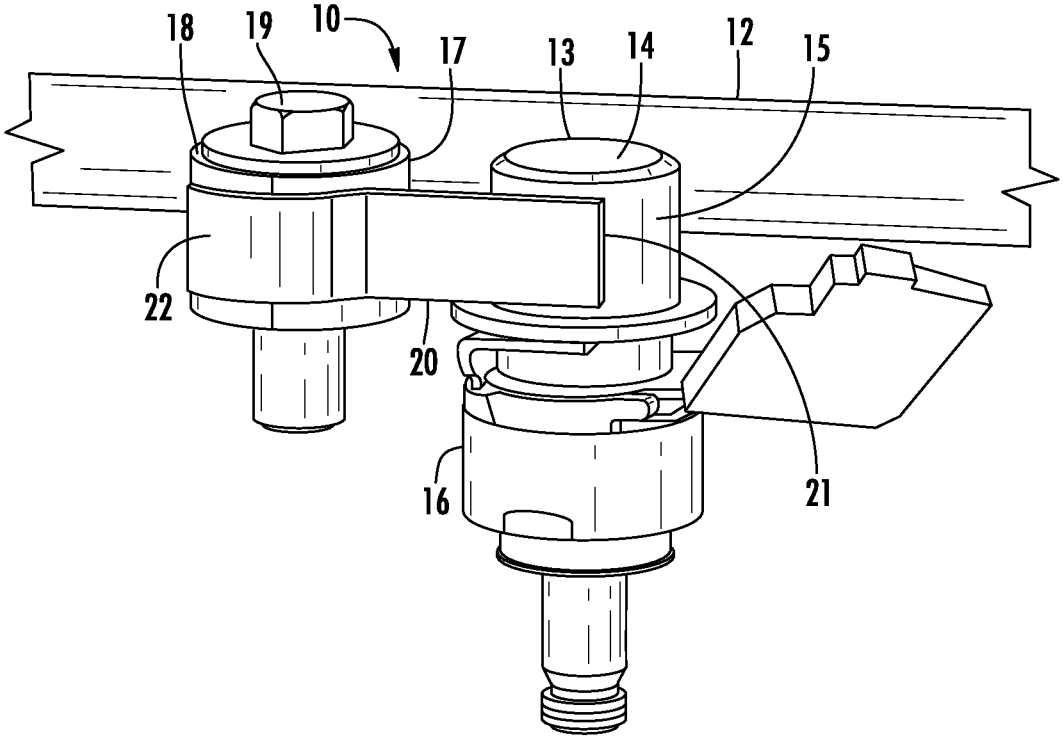
FIG. 1 is a schematic illustration of a GDI fuel rail injector mounting system depicting the preferred embodiment of the present disclosure.
Figure 2:
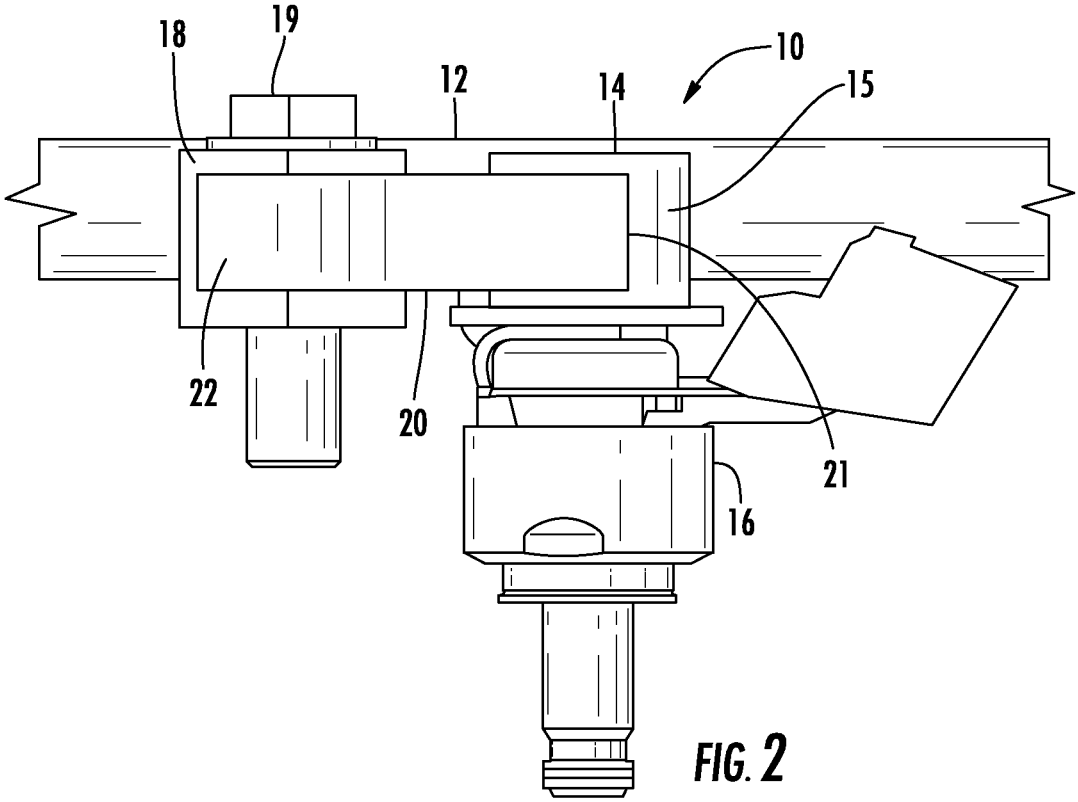
FIG. 2 is a side view of the GDI fuel rail injector mounting system displayed in FIG. 1.

Referring initially to FIGS. 1 & 2, a GDI fuel rail mounting system 10 is shown. The mounting system 10 comprises a tubular fuel rail 12, at least one fuel injector receiving cup 14 and at least one attachment means 18, associated with the fuel injector receiving cup 14. The fuel injector receiving cup 14 is generally circular in shape, and has a aperture in a bottom side for receiving a fuel injector 16 which is accordingly received in the cylinder head (not shown) of an internal combustion engine for providing a predetermined amount of fuel at a specified time during the combustion cycle. The fuel injector receiving cup 14 is attached offset from the fuel rail 12 centerline at an injector cup connection location 13 through brazing or some other similar means. There is fluid connection between the tubular fuel rail 12 and the fuel injector receiving cup 14.

The attachment means 18, also generally cylindrical in shape, is positioned along the fuel rail a predetermined distance from the associated injector receiving cup 14. The attachment means 18 is oriented generally parallel to its associated injector receiving cup 14, and is attached offset to the fuel rail 12 centerline at an attachment means connection location 17 through brazing or some other similar means. It further comprises a through bore for receiving a fastener 19 which secures the fuel rail to an associated mounting hole in the cylinder head.

Interconnecting the attachment means 18 and its associated injector cup 14, generally parallel to and distal from the fuel rail 12 is a securing strap 20, attached to both the injector cup 14 and the attachment means 18 through welding, brazing or some other similar means known in the art. The securing strap 20 is generally planar in shape, having at least one curved first end 22, which is complementary to the curvature of the attachment means 18 and partially wraps around the distal side of the attachment means 18, opposite from the fuel rail as illustrated in FIG. 1.

The opposite second end 21, in the preferred embodiment is planar as shown, but in a further embodiment may have a similar curvature as the first end 22 which is complementary to the curvature of the associated injector cup 14. It is important to note, the securing strap 20 is attached to both the attachment base 18 and the injector cup 14 parallel to but opposite from both the attachment base connection location 17 to the fuel rail 12 and the injector cup connection location 13 attachment to the fuel rail 12 respectively.

The securing strap 20 once attached provides a means to counteract the torsional, lineal and lateral forces imposed on the injector cup 14 during the firing of the fuel injector 16 by partially transferring these forces to the attachment means 18, minimizing the forces imposed upon the attachment point between the injector cup 14 and the fuel rail 12.

Figure 3A:
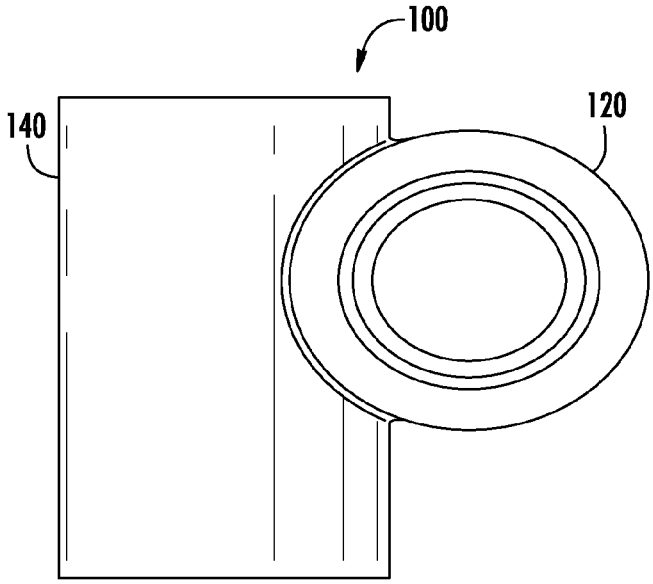
FIG. 3A is an end view of a standard GDI fuel rail injector mounting system without a securing strap.
Figure 3B:
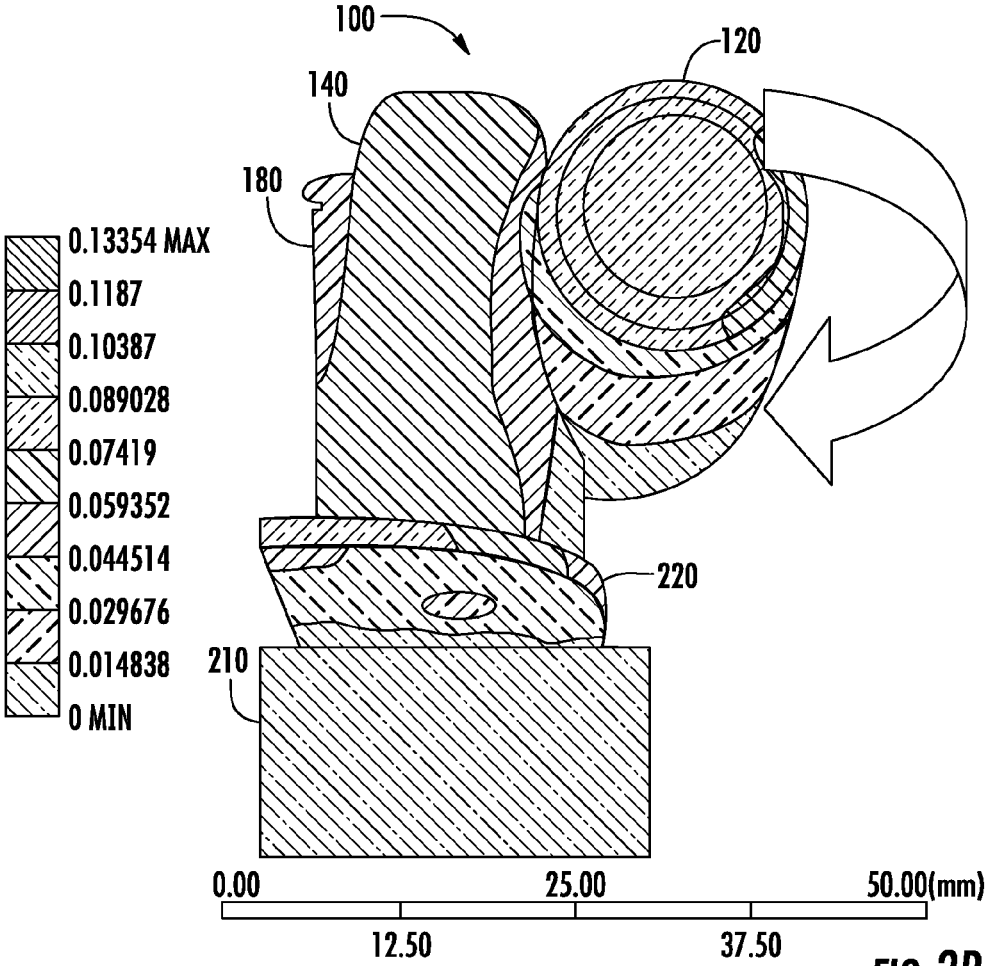
FIG. 3B is an end schematic illustration of the GDI fuel rail injector mounting system of FIG. 3A showing the output of stress analysis depicting the deformation that occurs under a load.
Figure 3C:
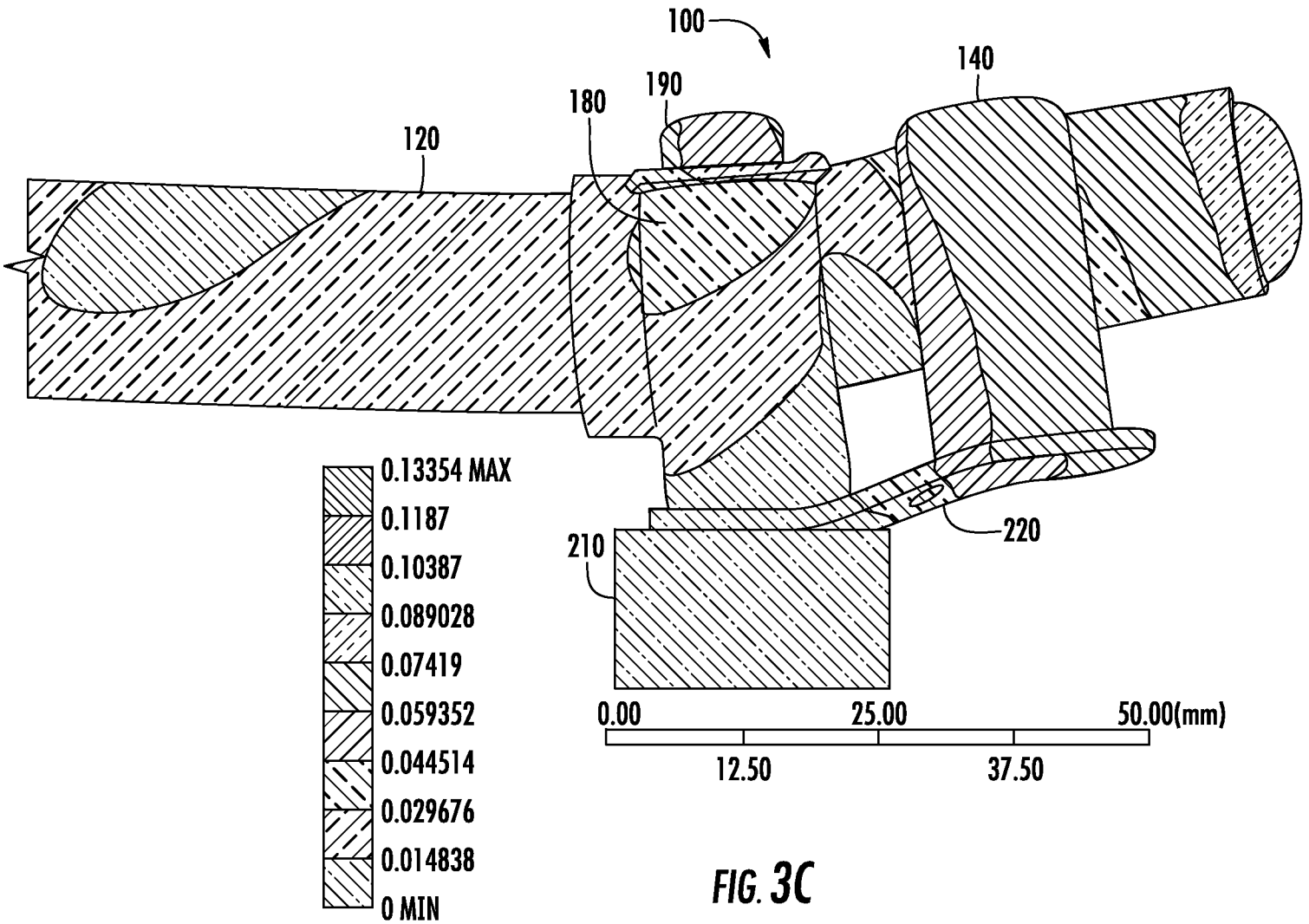
FIG. 3C is a side schematic illustration of the GDI fuel rail injector mounting system of FIGS. 3A & 3B without a securing strap under a load.

For illustration purposes of the above, please refer to FIGS. 3A-3C, showing a similar GDI fuel rail mounting system 100 lacking a securing strap as described above. In FIG. 3A, a fuel rail 120 with an injector cup 140 attached offset thereto is shown. In this figure, there is no imposing force applied to the injector cup 140. As FIGS. 3B & 3C illustrate, when load is applied due to fuel pressure, the torsional, lineal and lateral forces being imposed upon the injector cup 140, attachment means 180, attachment hardware 190, and fuel rail 120 in relation to the cylinder head 210 to which the assembly is attached is shown by way of the deformation in millimeters (mm). In this example, a bridge plate 220 interconnecting the bottom of the attachment means 180 and the injector cup 140 is utilized to show the amount of deflection and deformation which can occur. Without a securing strap, the injector cup 140 transfers the entire load to the point of attachment of the injector cup 140 to the fuel rail 120, and through the fuel rail 120, to the point of attachment between the attachment means 180 to the fuel rail 120. This creates severe stress in bending and torsional modes. An example of the deflection of the injector cup under load as illustrated here is approximately 0.078 mm.

These repeated deflections inherently cause premature failure of the fuel rail mounting system after repeated firings of the fuel injector either at the point of attachment of the injector cup 140 to the fuel rail 120; the attachment means 180 to the fuel rail 120, or both.

Figure 4A:
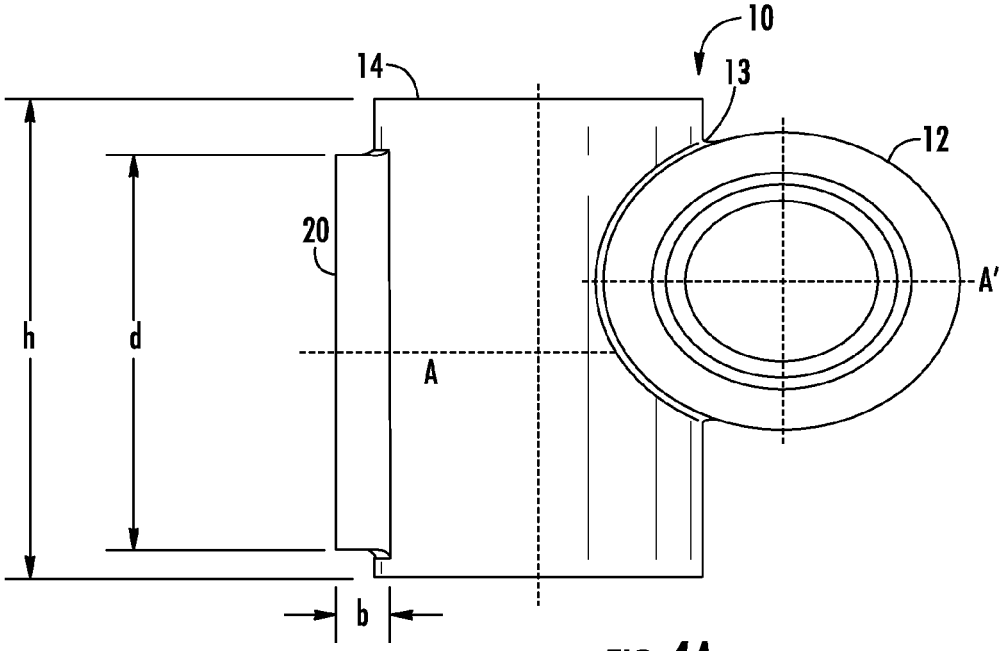
FIG. 4A is an end view of a GDI fuel rail injector mounting system with a securing strap.
Figure 4B:
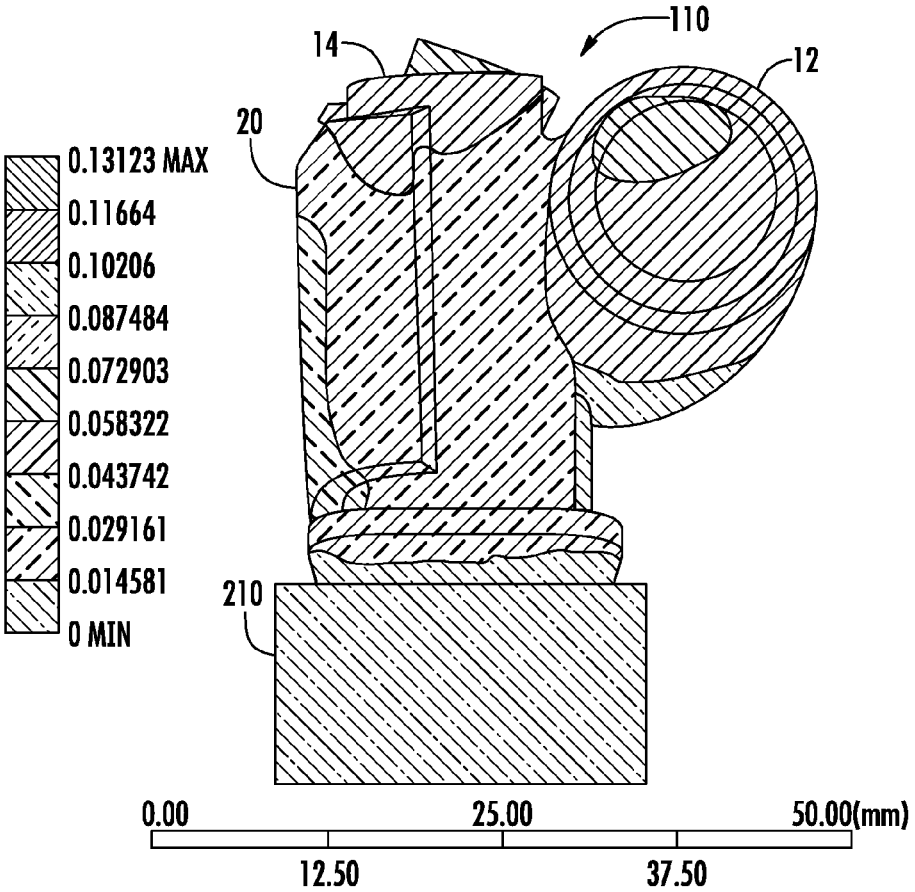
FIG. 4B is an end schematic illustration of the GDI fuel rail injector mounting system of FIG. 4A with a securing strap, showing the output of stress analysis depicting the deformation that occurs under a load.
Figure 4C:
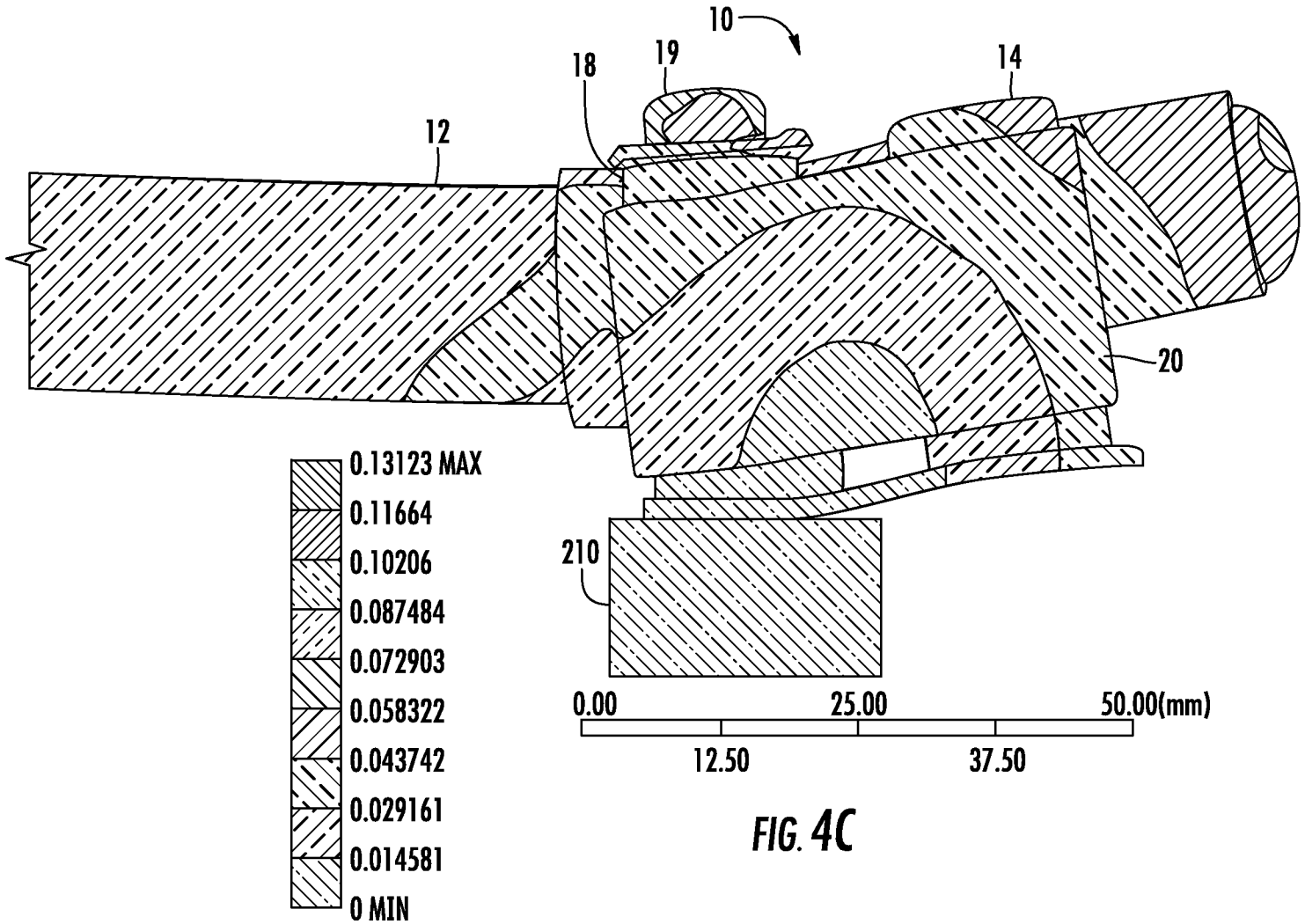
FIG. 4C is a side schematic illustration of the GDI fuel rail injector mounting system of FIGS. 4A & 4B with a securing strap under a load.

Referring now to FIGS. 4A-4C showing the preferred embodiment of the GDI fuel rail mounting system 10 incorporating a securing strap 20 will be described in comparison. In FIG. 4A, a fuel rail 12 with an injector cup 14 attached offset thereto with a securing strap 20 is shown. In this figure, there is no imposing force applied to the injector cup 14 from a fuel injection event. The securing strap 20 has dimensional depth (d) and breadth (b) so as (d)>(b) such that the section modulus is maximized ($b.d^2/6$). Furthermore, the securing strap depth (d) is greater than ½ the height (h) of both the injector cup 14 and attachment means 18, so that it extends on either side of the (neutral) axis (A) as shown. Due to variances in applications, the axis (A) may or may not be collinear with the centerline axis (A') of the fuel rail 12. It may be angled up or down by a predetermined factor.

As FIGS. 4B & 4C illustrate, during loading due to fuel pressure, the torsional, lineal and lateral forces being imposed upon the injector cup 14, attachment means 18, attachment hardware 19, and fuel rail 12 in relation to the cylinder head 210 to which the assembly is attached is also shown by way of the deformation in millimeters (mm). With the addition of the securing strap 20, the load that the fuel rail 12 transfers to the point of attachment between the attachment means 18 and the fuel rail 12 is partially transferred to the attachment means 18 directly, resulting in minimized deflection as shown. An example of the deflection of the injector cup under load as illustrated here is approximately 0.036 mm.

Injector cup deflection without strap: 0.089 mm

Injector cup deflection with strap: 0.036 mm

% Deflection Reduction=54%

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the Figures. Spatially relative terms may be intended to encompass different orientations of the device in use or operation in addition to the orientation depicted in the Figures. For example, if the device in the Figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A gasoline direct injection fuel rail mounting system for an internal combustion engine comprising:

a fuel rail;

at least one fuel injector receiving cup attached to the fuel rail offset from a centerline of the fuel rail, at a fuel injector cup connection location;

at least one attachment base associated with the fuel injector receiving cup attached to the fuel rail offset from the centerline of the fuel rail at an attachment base connection location for mounting the fuel rail to the internal combustion engine, the attachment base being positioned a predetermined distance along the fuel rail from the fuel injector receiving cup in a longitudinal direction; and a securing strap, the securing strap being generally planar and attached to both the attachment base and injector receiving cup, distal to the attachment base connection location and injector cup connection location relative to and parallel with the centerline of the fuel rail, the securing strap having a top edge parallel to and aligned horizontally with a top side of the fuel rail, wherein a horizontal centerline of the fuel rail, and a horizontal centerline of the securing strap are the same.

2. The fuel rail mounting system of claim 1, wherein the at least one attachment base and the at least one injector receiving cup are both cylindrical and each of the at least one attachment means base and the at least one injector receiving cup having a respective centerline generally perpendicular to and offset from the centerline of the fuel rail.

3. The fuel rail mounting system of claim 2, wherein the securing strap is attached to an outside surface of both the attachment base and the at least one injector receiving cup, approximately 180 degrees from the attachment base connection location and the injector cup connection location relative to the centerline of the attachment means and the centerline of the injector receiving cup respectively.

4. The fuel rail mounting system of claim 2, wherein the securing strap has at least one curved surface complementing an outside radius of the at least one attachment base.

5. The fuel rail mounting system of claim 4, wherein the securing strap has two curved surfaces complementing the outside radius of the at least one attachment base and the at least one injector receiving cup.

6. The fuel rail mounting system of claim 4, wherein the securing strap is attached to the at least one attachment base and the at least one injector receiving cup through brazing.

7. The fuel rail mounting system of claim 4, wherein there is an open space provided directly between the opposing sides of the at least one attachment base and the at least one injector receiving cup.

* * * * *